US007976651B2

(12) United States Patent
Fujiwara et al.

(10) Patent No.: US 7,976,651 B2
(45) Date of Patent: Jul. 12, 2011

(54) WELDABLE STEEL OF HIGH STRENGTH AND HIGH TOUGHNESS, AND METHOD OF PRODUCING MEMBERS USING THE SAME

(75) Inventors: Masanao Fujiwara, Aichi (JP); Hiroaki Yoshida, Aichi (JP); Masaki Shinkawa, Wako (JP); Yoshikazu Umeno, Wako (JP); Toshiaki Otsuka, Wako (JP)

(73) Assignees: Daido Steel Co., Ltd., Nagoya (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/801,317

(22) Filed: Jun. 3, 2010

(65) Prior Publication Data

US 2010/0243110 A1 Sep. 30, 2010

Related U.S. Application Data

(62) Division of application No. 11/526,651, filed on Sep. 26, 2006, now abandoned.

(30) Foreign Application Priority Data

Sep. 26, 2005 (JP) ..... 2005-278760

(51) Int. Cl.
*C21D 1/02* (2006.01)
*C21D 1/18* (2006.01)
*C21D 8/00* (2006.01)

(52) U.S. Cl. ..... 148/649; 148/654

(58) Field of Classification Search ..... 148/649, 148/650, 651

See application file for complete search history.

(56) References Cited

U.S. PATENT DOCUMENTS

| | | | | |
|---|---|---|---|---|
| 5,820,706 | A * | 10/1998 | Bellus et al. | 148/649 |
| 6,188,037 | B1 | 2/2001 | Hamada et al. | |
| 2002/0011286 | A1 | 1/2002 | Kan et al. | |
| 2004/0129348 | A1 | 7/2004 | Ikeda et al. | |

FOREIGN PATENT DOCUMENTS

| | | | |
|---|---|---|---|
| JP | 06-212347 | * | 8/1994 |
| JP | A-2000-303147 | | 10/2000 |

OTHER PUBLICATIONS

H. Paxton, "Steel," Oct. 15, 2004, Kirk-Othmer Encyclopedia of Chemical Technology, John Wiley & Sons, Inc., p. 1-79.

Office Action issued by the U.S. Patent Office on Feb. 17, 2009 in connection with parent U.S. Appl. No. 11/526,651.

Office Action issued by the U.S. Patent Office on Dec. 9, 2009 in connection with parent U.S. Appl. No. 11/526,651.

Full English Translation of JP-A-2000-303147, Inventor: Koji Nakamura, Published Oct. 31, 2000, 32 pages total.

* cited by examiner

*Primary Examiner* — George Wyszomierski
*Assistant Examiner* — Mark L Shevin
(74) *Attorney, Agent, or Firm* — Posz Law Group, PLC

(57) ABSTRACT

Disclosed are a weldable steel of high strength and high toughness and a method of producing members of machine parts. The steel consists essentially of, by weight %, C: 0.10-0.16%, Si: 0.05-0.50%, Mn: 1.3-2.3%, Cu: up to 0.5%, Ni: up to 0.5%, Cr: up to 0.5%, Mo: up to 0.3% and Ti: 0.025-0.035%, and the balance of Fe and inevitable impurities, and satisfying the condition that the weld-cracking susceptibility, Pcm, defined by the formula 1A below is less than 0.35, and the condition that the manganese equivalent, Mneq, defined by the formula 2A below is larger than 2.0.

$$Pcm=C(\%)+Si(\%)/30+Mn(\%)/20+Ni(\%)/60+Cr(\%)/20+Mo(\%)/15+Cu(\%)/20 \quad 1A$$

$$Mneq=Mn(\%)+Cu(\%)+Ni(\%)/2+Cr(\%)+Mo(\%) \quad 2A$$

8 Claims, 2 Drawing Sheets

WELDABLE STEEL OF HIGH STRENGTH AND HIGH TOUGHNESS, AND METHOD OF PRODUCING MEMBERS USING THE SAME

CROSS REFERENCE TO RELATED APPLICATION

This application is a divisional application of U.S. patent application Ser. No. 11/526,651 filed on Sep. 26, 2006 and entitled "WELDABLE STEEL OF HIGH STRENGTH AND HIGH TOUGHNESS, AND METHOD OF PRODUCING MEMBERS USING THE SAME," now abandoned, which claims priority from Japanese Application No. 2005-278760 filed on Sep. 26, 2005, the contents of each being incorporated herein by reference.

BACKGROUND OF THE INVENTION

1. Field in the Industry

The present invention concerns a weldable steel of high strength and high toughness. The invention also concerns a method of producing steel members for the parts such as automobile parts using the steel.

2. State of the Art

In the event of manufacturing various machine parts with steel materials, if two or more components can be welded to form the shape of the part, it will be easy to manufacture complicated products. Then, it is possible to reduce the number of the parts by gathering two or more components, which have been to date combined with bolts and nuts, into one part, and resulting decrease in weight of the parts and reduction of the manufacturing costs will be enjoyable. However, in cases where high strength and high toughness are required to the parts, there is a problem that the steel of such properties has poor weldability and thus, it is difficult to manufacture desired parts by combining particular members. One falls into dilemma that, for the purpose of heightening weldability of the steel it is necessary to choose an alloy composition of lower carbon content, while the low carbon steel has lower hardness, lower toughness and lower strength.

In order to maintain the weldability of the steel high it is essential not to lower the toughness of the heat-effected parts around the welded parts. In general, hardness of the heat-effected parts goes to too high a level of 400 HV due to martensitic transformation caused by heat given during welding and rapid cooling thereafter, and then, the heat-effected parts become brittle and weld-cracking may occur. Because the hardness of the steel after the martensitic transformation depends mainly on the carbon content, it is necessary to keep content of the components, particularly carbon, which increase hardness low, for the purpose of avoiding occurrence of extremely hard heat-effected parts. From this point of view an index for keeping the contents of the components which increase the hardness low "Index of Weld-Cracking Susceptibility" (hereinafter abbreviated to "Pcm") is known and used.

On the other hand, too low a carbon content makes the strength of the steel insufficient. A countermeasure for this problem is to increase hardenability of the steel by, while maintaining the C-content, regulating the contents of the other alloying elements so that the depth of hardened layer may be deep and the averaged hardness of the welded products may be high, thereby to maintain the strength of the products. From this point of view, an index for deciding the minimum contents of the alloying elements which influence the hardenability, "Manganese Equivalent" has been discussed (hereinafter abbreviated to "Mneq").

In regard to the steel of low yield ratio-high strength used for architectural constructions or large scale structure such as bridges there has been proposed a steel having a specific alloy composition, a structure consisting of (by volume %) polygonal ferrite 5-30%, MA (mixture of martensite and austenite) 3-15% and the balance of bainite, and the averaged size of the MA is up to 5 micrometer, as a material having good toughness and the weldability (Japanese patent disclosure No. 2004-315925). The patent literature, however, discloses in regard to the weldability only the results of heat-cycle tests which simulate welding (HAZ-toughness).

The inventors made research to seek the way of keeping the toughness at the heat effected parts at manufacturing steel parts in which the base metal maintains the necessary strength and toughness with the requisites that the above noted two indices related to the weld-crack susceptibility and the hardenability are chosen to be appropriate values. They discovered a useful steel of specific alloy composition and found that application of specific processing conditions to the steel makes it possible to solve the above noted problem.

SUMMARY OF THE INVENTION

The object of the invention is to utilize the inventors' knowledge and to provide a steel which is of high strength and high toughness, and still weldable. To provide a method of producing machine part members using the steel is included in the object of the invention. The term "weldable" here means not only that the steel can be welded without weld-cracking but also a positive property that the welded parts have sufficiently high toughness.

The weldable steel having high strength and high toughness according to the invention has a basic alloy composition consisting according to the invention has a basic alloy composition consisting essentially of, by weight %, C: 0.10-0.16%, Si: 0.05-0.50%, Mn: 1.3-2.3%. Cu: up to 0.5%, Ni: up to 0.5%, Cr: up to 0.5%, Mo: up to 0.3% and Ti: 0.025-0.035%, and the balance of Fe and inevitable impurities, and satisfies the condition that the weld-crack susceptibility. Pcm, defined by the formula 1A below is less than 0.35, and the condition that the manganese equivalent Mneq defined by the formula 2A below is larger than 2.0.

$$Pcm=C(\%)+Si(\%)/30+Mn(\%)/20+Ni(\%)/60+Cr(\%)/20+Mo(\%)/15+Cu(\%)/20 \quad 1A$$

$$Mneq.=Mn(\%)+Cu(\%)+Ni(\%)/2+Cr(\%)+Mo(\%) \quad 2A$$

DETAILED EXPLANATION OF THE PREFERRED EMBODIMENTS

The steel of the present invention may contain, in addition to the above described alloy components, B: 0.0003-0.005%. Addition of a suitable amount of B enhances hardenability of the steel and is generally preferable. In case where the alloy contains B the above noted formulas 1A and 2A will be formulas 1B and 2B described below:

$$Pcm=C(\%)+Si(\%)/30+Mn(\%)/20+Ni(\%)/60+Cr(\%)/20+Mo(\%)/15+Cu(\%)/20+5B(\%) \quad 1B$$

$$Mneq.=Mn(\%)+Cu(\%)+Ni(\%)/2+Cr(\%)+Mo(\%)+0.5 \quad 2B$$

The method of manufacturing the steel member according to the invention uses the above described steel of the alloy composition with or without B and comprises one of the processing and heat-treating steps mentioned below:

1) Forging at a temperature of 1050° C. or higher to give the shape of the member, and after cooling, reheating to a temperature of A, transformation or higher and quenching to harden and tempering to a determined hardness (Embodiment of FIG. 1);
2) Forging at a temperature of 1050° C. or higher to give the shape of the member, and directly after forging, quenching to harden and tempering to a determined hardness;
3) Forging at a temperature higher than 1050° C. but not exceeding 1150° C. to give the shape of the member, and directly after forging, quenching to harden and tempering to a determined hardness (Embodiment of FIG. 2);
4) First forging at a temperature higher than 1050° C. and then, at least one further forging to give the shape of the member, in which the last forging is carried out at a temperature in the range of 900-1000° C., and directly after the last forging, quenching to harden and tempering to a determined hardness;

and

Figure 3:
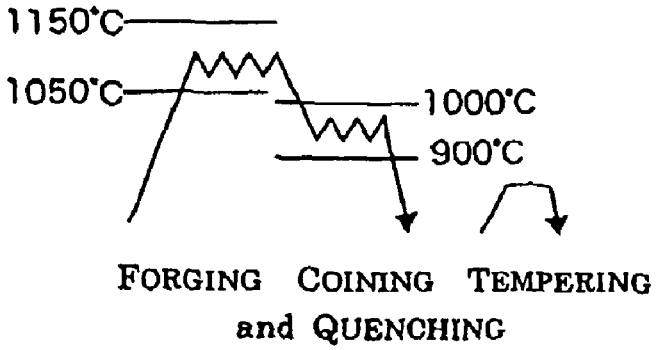
FIG. 3 is a conceptual figure showing the process for producing the steel member according to a more preferable embodiment also of the present invention.

5) Forging at a temperature higher than 1050° C. but not exceeding 1150° C., at least one further forging to give the shape of the member, in which the last forging is carried out at a temperature in the range of 900-1000° C., and directly after forging, quenching to harden and tempering to a determined hardness (Embodiment of FIG. 3).

The forging step for obtaining the member from the steel material is usually carried out at such a relatively high temperature as 1250° C. or so for the easiness of the deforming. The forging manner adopted by the present invention, which may be called a semi-hot forging, carried out at such a relatively low temperature as over $A_3$ transformation point but below 1100° C. give, together with appropriate choice of the weld-crack susceptibility and the manganese equivalent, high strength and high toughness, which have been difficult to be consistent to each other.

The above discussed relatively low forging temperature increases the toughness by making the martensitic structure after hardening fine. In order to rely on this mechanism it is preferable to choose the temperature as low as possible permitted by the forging device in the range of 900° C. or higher but not exceeding 1000° C. Then, as seen from the data of the working examples described below, a higher toughness can be realized at the welded parts, and thus, excellent parts can be manufactured.

The forging operation can be done in two or more steps. In that case it is preferable to carryout the last forging at a lower temperature as noted above to obtain a better result, and then, to directly quench to harden. This will give the same effect as the case where whole the forging is carried out at a low temperature. Choosing this sequence of steps makes it possible to combine an early stage forging with large deformation at a relatively high temperature with easy deformation, and the latter stage or the rest of the forging at a relatively low temperature. The forging at a temperature in the range of 900° C. to 1000° C. may be so-called hot-coining with small deformation.

The following explains the reason why the alloy composition of the present steel is determined as described above.

C: 0.10-0.16%

Carbon is an essential component to ensure the strength of the matrix. A small content less than 0.10% will not give the desired strength. On the other hand, too much addition affects the weldability and results in lower toughness at the heat-effected parts, and thus, 0.16% is set as the upper limit.

Si: 0.05-0.50%

Silicon acts as a deoxidizing agent of the steel. For effective use 0.05% or more of Si is added. Excess addition lowers the weldability and toughness of the steel, and thus, the addition must be in an amount up to 0.50%.

Mn: 1.3-2.3%

Manganese is also a deoxidizing agent. In the present steel Mn is a component at the head of the members in the formula of the manganese equivalent. In order to achieve the necessary manganese equivalent and ensure the strength 1.3% or more of Mn is added. On the other hand, too much Mn increases the weld-crack susceptibility to cause weld-cracking, and further, decreases toughness of the welded parts. Thus, the addition of Mn should be in an amount up to 2.3%.

Cu: Up to 0.5%

Copper appears in the formula of the manganese equivalent. Addition of Cu in a suitable amount enhances hardenability and contributes to the strength of the steel. Addition of a large amount affects the toughness of the steel, and therefore, the upper limit of addition is 0.5%.

Ni: Up to 0.5%

Nickel contributes to the hardenability of the steel, while the effect to the weld-crack susceptibility is small, and therefore, a suitable amount of Ni should be added. Because this is an expensive material, the upper limit of 0.5% was set from the economical point of view.

Cr: Up to 0.8%

Chromium is an element also appearing in the formula of manganese equivalent and increase the hardenability. Too much content will influence the weld-crack susceptibility, and therefore, addition must be made in the amount up to 0.8%.

Mo: Up to 0.3%

Molybdenum contributes to the hardenability like nickel and chromium. Because this metal is expensive it is advisable to add in a small amount up to 0.3%.

Ti: Up to 0.06%

Titanium combines with nitrogen to form TiN, which contributes to increase in the strength. To secure this effect a certain amount of Ti is added. If, however, the addition amount is too large, toughness of the heat-effected parts will be low. The upper limit of addition is 0.06%. Preferable range is 0.015-0.05%.

B: In Case of Addition, 0.0003-0.005%

Boron segregates at the austenitic grain boundaries before quenching and suppresses ferritic transformation to increase hardenability. Thus, addition of a certain amount of B is recommended. However, if the manganese equivalent is so high as 2.0 or more to give sufficient hardenability, addition of B is unnecessary. In case of addition a suitable amount is in the range of 0.0003-0.005%.

Because the weld-crack susceptibility of the steel member obtained by the method of the present invention is suppressed low, no welded part has such a high hardness as 400 HV, and hence, it is possible to avoid the problem of cracking during welding as well as high toughness at the welded parts. Also, the steel has such high hardenability as sufficient hardness is realized in whole the member by quenching after the forging. Consequently, the machine parts made by welding the members have high strength.

EXAMPLES

The steels of the alloy composition shown in Table 1 (weight %, balance Fe) were prepared. The steels were heated to 1100° C. and forged with reduction in height of 50% to form bulk materials of thickness 30 mm. The materials were hardened, and from the hardened materials, test pieces of thickness 3 mm were taken and tempered at 465° C.×1 hour.

Two test pieces of each steel were welded by overlapping fillet welding. The filler materials are the same as the base metals. The welded parts of this fillet welding were subjected to measurement of the hardness, the results of which are shown in Table 2. The weldability was evaluated with the maximum hardness of the base metals, and those of the hardness less than 400 HV were recorded as "good". The hardness was measured at the central parts of the base metals in the thickness direction, with evaluation "good" for those of 250 HV or more and "no good" for those of less than 250 HV. In Table 2 control examples are accompanied by the reason why they are out of the claimed invention.

The steels "A", "B" and "C", which are the working examples of the present invention, fulfill the requirement of both the weldability and the hardness of the base metals.

In the control examples "D" to "H" one or both of weldability and hardness of the base metals are inferior due to the following reason:

D: Weldability is low because carbon content is too large and the value of Pcm is out of the range of the invention;

E: Hardness of the base metal is too high due to insufficient Mn-content, which makes the Mneq out of the claimed range;

F: Hardness of the base metal is low. Because the steel contain no B, and the Mneq is out of the range of the present invention;

G: Weldability is low. Though the alloying elements are in the Range of the invention, Pcm is out of the range; and H: Hardness of the base metal is too high. Though the amounts of the alloying elements are in the range, Mneq is out of the range.

TABLE 1

| Steel | C | Si | Mn | Cu | Ni | Cr | Mo | Ti | B | Pcm | Mneq |
|---|---|---|---|---|---|---|---|---|---|---|---|
| Working Example | | | | | | | | | | | |
| A | 0.16 | 0.40 | 2.30 | 0.30 | 0.20 | 0.50 | 0.05 | 0.045 | 0.0030 | 0.34 | 3.8 |
| B | 0.10 | 0.15 | 1.30 | 0.10 | 0.10 | 0.10 | 0.02 | 0.015 | 0.0005 | 0.18 | 2.1 |
| C | 0.14 | 0.25 | 1.60 | 0.10 | 0.20 | 0.40 | 0.02 | 0.015 | — | 0.26 | 2.2 |
| Control Example | | | | | | | | | | | |
| D | 0.29 | 0.25 | 1.40 | 0.20 | 0.10 | 0.20 | 0.02 | 0.035 | 0.0015 | 0.39 | 2.4 |
| E | 0.11 | 0.25 | 0.75 | 0.20 | 0.10 | 0.20 | 0.02 | 0.035 | 0.0015 | 0.19 | 1.7 |
| F | 0.11 | 0.25 | 1.40 | 0.20 | 0.10 | 0.20 | 0.02 | 0.035 | — | 0.21 | 1.9 |
| G | 0.16 | 0.35 | 2.30 | 0.30 | 0.30 | 0.80 | 0.02 | 0.035 | 0.0015 | 0.36 | 4.3 |
| H | 0.10 | 0.25 | 1.40 | — | 0.02 | 0.02 | — | 0.025 | 0.0015 | 0.18 | 1.9 |

TABLE 2

| Steel | Weldability (maximum hardness At the heat-effected Parts (hardness HV) | Hardness of the Base Metal (Central Parts in the thickness direction (hardness HV) |
|---|---|---|
| Working Examples | | |
| A | good (388) | good (307) |
| B | good (352) | good (262) |
| C | good (368) | good (312) |
| Control Examples | | |
| D | no good (441) | no good (362) |
| E | good (372) | no good (307) |
| F | good (381) | no good (215) |
| G | no good (423) | good (323) |
| H | good (376) | no good (233) |

Then, the steel "A", a working example and the steel "E", a control example were subjected to forging of reduction of area 65% followed by quenching and tempering in accordance with the four processing and heat-treatment procedures below.

1) Hot Forging/Reheating-Quenching/Tempering

Figure 1:
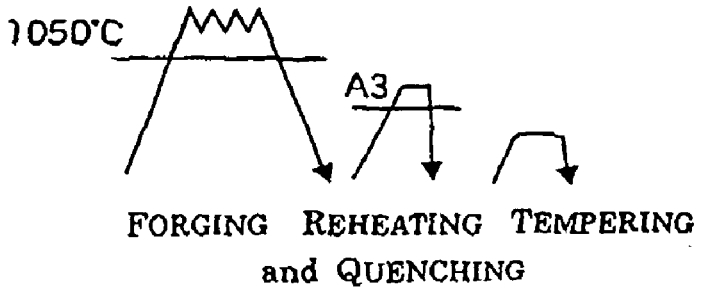
FIG. 1 is a conceptual figure showing the process for producing the steel member according to the conventional technology or the present invention.

Conventional Technology, an Embodiment of FIG. 1

The steel "E" of the control example was hot forged at 1200° C., reheated to 900° C. and quenched→tempered at 465° C.×1 hour.

2) Hot Forging/Reheating-Quenching/Tempering

Example of the Present Invention, an Embodiment of FIG. 1

The steel "A" of the working example was hot forged at 1200° C., reheated to 900° C. and quenched→tempered at 465° C.×1 hour.

3) Low Temperature Forging-Quenching/Tempering

Figure 2:
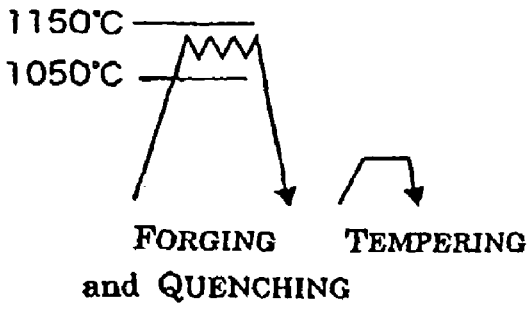
FIG. 2 is a conceptual figure showing the process for producing the steel member according to a preferred embodiment of the present invention.

Preferable Examples According to the Invention, Embodiments of FIG. 2 and FIG. 3

The steel "A" of the working example was forged under temperature controlling at 1100° C. and quenched→tempered at 465° C.×1 hour;

The steel "A" of the working example was forged under temperature controlling at 1100° C.→forged by coining at 900-1000° C. and quenched→tempered at 465° C.×1 hour.

4) Low Temperature Forging/Quenching/Tempering

A Control Example Outside the Scope of the Invention

The steel "A" of the working example was forged under temperature controlling at 1100° C. at quenched→forged by coining at 800° C. and quenched→tempered at 465° C.×1 hour.

Figure 4:
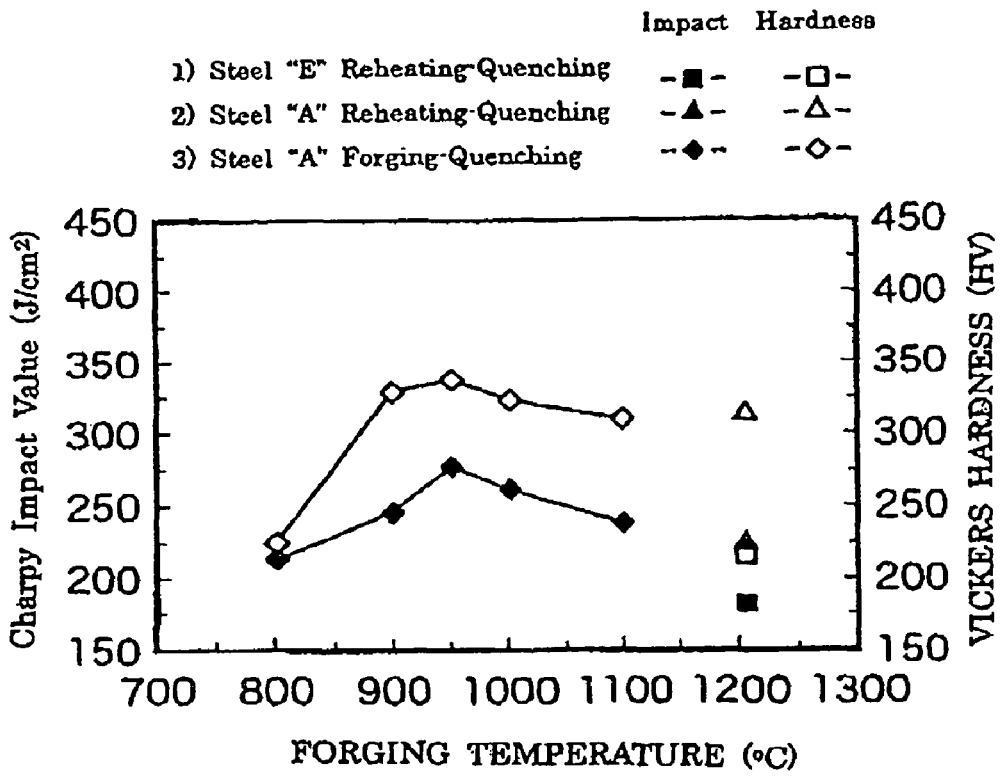
FIG. 4 is a graph showing the relations between the forging temperature and Charpy impact value or Vickers' hardness obtained in the working examples of the present invention.

The above forged and heat-treated products were subjected to Charpy impact test to determine the impact values at 23° C. and hardness test to determine the Vickers hardness. The relations between the forging temperature and impact value or Vickers hardness are shown in FIG. 4. FIG. 4 shows that the known material has insufficient hardenability, and therefore, hardness (strength) after heat treatment is low, while the steel of the invention, having sufficient hardenability, exhibits satisfactory hardness and toughness. Furthermore, in the steel of the invention, when the final forging temperature is low, due to finer crystal grains, the strength and the toughness are much more improved. However, if the temperature of the final forging is too low, the processing is carried out in the low-temperature austenitic zone and hence, the ferritic transformation or pearlitic transformation is accelerated and causes decrease in the hardenability. In this case martensitic transformation will be insufficient and the hardness (strength) will be significantly decreased.

We claim:

1. A method of producing weldable automobile parts, which comprises steps of:

forging the weldable automobile parts at a temperature of 1050° C. or higher and shaping the weldable automobile parts;

reheating to $A_3$-transformation point or higher;

quenching and tempering to a pre-determined hardness, wherein the weldable automobile parts consist essentially of, by weight %, C: 0.10-0.16%, Si: 0.05-0.50%, Mn: 1.3-2.3%, Cu: up to 0.5%, Ni: up to 0.5%, Cr: up to 0.8%, Mo: up to 0.3% and Ti: up to 0.06%, and the balance of Fe and inevitable impurities, and satisfy the condition that the weld-cracking susceptibility, Pcm, defined by the formula 1A below is less than 0.35, and the condition that the manganese equivalent, Mneq, defined by the formula 2A below is larger than 2.0, wherein $$Pcm=C(\%)+Si(\%)/30+Mn(\%)/20+Ni(\%)/60+Cr(\%)/20+Mo(\%)/15+Cu(\%)/20, \text{ and} \quad 1A$$

$$Mneq=Mn(\%)+Cu(\%)+Ni(\%)/2+Cr(\%)+Mo(\%), \text{ and} \quad 2A$$

wherein the forging includes a first forging of the steel at a temperature of 1050° C. or higher followed by at least one another forging to give shape to the weldable automobile parts, the last forging being carried out at a temperature of 900-1000° C., and directly quenching after the last forging.

2. The method of producing weldable automotive parts according to claim 1, wherein the weldable automobile parts further consist essentially of B: 0.0003-0.005% and satisfy the condition that the weld-crack susceptibility, Pcm, defined by formula 1B is less than 0.35 and the condition that the manganese equivalent, Mneq, defined by formula 2B is larger than 2.0, wherein $$Pcm=C(\%)+Si(\%)/30+Mn(\%)/20+Ni(\%)/60+Cr(\%)/20+Mo(\%)/15+Cu(\%)/20+5B(\%), \text{ and} \quad 1B$$

$$Mneq=Mn(\%)+Cu(\%)+Ni(\%)/2+Cr(\%)+Mo(\%)+0.5. \quad 2B$$

3. The method of producing weldable automotive parts according to claim 1, wherein the first forging is carried out at a temperature of 1050° C. or higher but not exceeding 1150° C.

4. The method of producing weldable automotive parts according to claim 2, wherein the first forging is carried out at a temperature of 1050° C. or higher but not exceeding 1150° C.

5. A method of producing weldable automotive parts, which comprises steps of:

forging the weldable automobile parts at a temperature of 1050° C. or higher and shaping the weldable automobile parts;

directly quenching and tempering to a pre-determined hardness, wherein the weldable automobile parts consist essentially of, by weight %, C: 0.10-0.16%, Si: 0.05-0.50%, Mn: 1.3-2.3%, Cu: up to 0.5%, Ni: up to 0.5%, Cr: up to 0.8%, Mo: up to 0.3% and Ti: up to 0.06%, and the balance of Fe and inevitable impurities, and satisfy the condition that the weld-cracking susceptibility, Pcm, defined by the formula 1A below is less than 0.35, and the condition that the manganese equivalent, Mneq, defined by the formula 2A below is larger than 2.0, wherein $$Pcm=C(\%)+Si(\%)/30+Mn(\%)/20+Ni(\%)/60+Cr(\%)/20+Mo(\%)/15+Cu(\%)/20, \text{ and} \quad 1A$$

$$Mneq=Mn(\%)+Cu(\%)+Ni(\%)/2+Cr(\%)+Mo(\%), \text{ and} \quad 2A$$

wherein the forging includes a first forging of the steel at a temperature of 1050° C. or higher followed by at least one another forging to give shape to the weldable automobile parts, the last forging being carried out at a temperature of 900-1000° C., and directly quenching after the last forging.

6. The method of producing weldable automotive parts according to claim 5, wherein the first forging is carried out at a temperature of 1050° C. or higher but not exceeding 1150° C.

7. The method of producing weldable automotive parts according to claim 5, wherein the weldable automobile parts further consist essentially of B: 0.0003-0.005% and satisfy the condition that the weld-crack susceptibility, Pcm, defined by formula 1B is less than 0.35 and the condition that the manganese equivalent, Mneq, defined by formula 2B is larger than 2.0, wherein $$Pcm=C(\%)+Si(\%)/30+Mn(\%)/20+Ni(\%)/60+Cr(\%)/20+Mo(\%)/15+Cu(\%)/20+5B(\%), \text{ and} \quad 1B$$

$$Mneq=Mn(\%)+Cu(\%)+Ni(\%)/2+Cr(\%)+Mo(\%)+0.5. \quad 2B$$

8. The method of producing weldable automotive parts according to claim 7, wherein the first forging is carried out at a temperature of 1050° C. or higher but not exceeding 1150° C.

* * * * *